US010100987B1

(12) United States Patent
Dell'Ario

(10) Patent No.: US 10,100,987 B1
(45) Date of Patent: Oct. 16, 2018

(54) LAMP WITH DIRECTIONAL, INDEPENDENTLY VARIABLE LIGHT SOURCES

(71) Applicant: Dale J Dell'Ario, Seattle, WA (US)

(72) Inventor: Dale J Dell'Ario, Seattle, WA (US)

(73) Assignee: Ario, Inc., Seattle, WA (US)

( * ) Notice: Subject to any disclaimer, the term of this patent is extended or adjusted under 35 U.S.C. 154(b) by 0 days.

(21) Appl. No.: 14/860,343

(22) Filed: Sep. 21, 2015

Related U.S. Application Data

(60) Provisional application No. 62/054,545, filed on Sep. 24, 2014.

(51) Int. Cl.

| | |
|---|---|
| ***F21S 6/00*** | (2006.01) |
| ***F21V 29/70*** | (2015.01) |
| ***H05B 33/08*** | (2006.01) |
| ***H05B 37/02*** | (2006.01) |
| *F21Y 101/02* | (2006.01) |
| *F21Y 113/00* | (2016.01) |
| *F21Y 113/13* | (2016.01) |
| *F21Y 101/00* | (2016.01) |
| *F21Y 105/10* | (2016.01) |

(52) U.S. Cl.
CPC ..... *F21S 6/008* (2013.01); *F21V 29/70* (2015.01); *H05B 33/0845* (2013.01); *H05B 37/029* (2013.01); *H05B 37/0281* (2013.01); *F21Y 2101/00* (2013.01); *F21Y 2101/02* (2013.01); *F21Y 2105/10* (2016.08); *F21Y 2113/005* (2013.01); *F21Y 2113/13* (2016.08)

(58) Field of Classification Search
CPC ..... F21S 6/008; F21V 29/70; H05B 37/0281
USPC ..... 362/231
See application file for complete search history.

(56) References Cited

U.S. PATENT DOCUMENTS

| | | | | |
|---|---|---|---|---|
| 1,790,179 A * | 1/1931 | Symmes | ..... | F21S 13/00 362/300 |
| 6,225,760 B1 | 5/2001 | Moan | | |
| 6,350,275 B1 | 2/2002 | Vreman et al. | | |
| 6,554,439 B1 | 4/2003 | Teicher et al. | | |

(Continued)

FOREIGN PATENT DOCUMENTS

| | | | | |
|---|---|---|---|---|
| EP | 2261553 A1 * | 12/2010 | ..... | F21S 8/06 |
| WO | WO 2014082419 A1 * | 6/2014 | ..... | F21S 8/00 |

OTHER PUBLICATIONS

International Search Report and Written Opinion of the ISA, in International Application No. PCT/US2016/052857, dated Nov. 29, 2016.

(Continued)

*Primary Examiner* — Elmito Breval
*Assistant Examiner* — Michael Chiang
(74) *Attorney, Agent, or Firm* — Brad Bertoglio

(57) ABSTRACT

A lighting device includes two or more independently controlled sources of light, operational within a structure having a ground surface and a ceiling surface. A first source of light emits light with predetermined correlated color temperature upward towards a portion of the ceiling directly above the lighting device, without obstruction from the lighting device. The second source of light emits light with a predetermined correlated color temperature downward, towards the floor surface. A controller independently adjusts the color temperature and intensity of the sources of light according to a time schedule.

6 Claims, 5 Drawing Sheets

(56) References Cited

U.S. PATENT DOCUMENTS 6,623,512 B1 9/2003 Heller et al.
6,686,691 B1 2/2004 Mueller et al.
7,679,281 B2 3/2010 Kim et al.
8,324,808 B2 12/2012 Maxik et al.
8,427,311 B2 * 4/2013 Schlangen ..... A61M 21/00 340/540
8,436,556 B2 5/2013 Eisele et al.
8,581,520 B1 11/2013 Wray
8,686,641 B2 4/2014 Maxik et al.
8,852,254 B2 10/2014 Moscovici
8,890,435 B2 11/2014 Bora et al.
9,039,746 B2 5/2015 Van De Ven et al.
9,095,029 B2 7/2015 Lu et al.
9,462,661 B2 * 10/2016 Barroso ..... H05B 33/086
2001/0022723 A1 * 9/2001 Siminovitch ..... F21S 6/002 362/225
2004/0249423 A1 12/2004 Savage
2006/0285324 A1 12/2006 Ansems et al.
2008/0065177 A1 3/2008 Casper et al.
2008/0275533 A1 11/2008 Powell
2009/0122530 A1 5/2009 Beers et al.
2009/0296403 A1 12/2009 Zhang et al.
2009/0326616 A1 12/2009 Aarts et al.
2011/0075404 A1 3/2011 Allen et al.
2011/0084614 A1 4/2011 Eisele et al.
2011/0109445 A1 5/2011 Weaver et al.
2012/0038291 A1 * 2/2012 Hasnain ..... H05B 33/0857 315/294
2012/0212953 A1 8/2012 Bloom et al.
2012/0306380 A1 12/2012 Adler
2013/0063935 A1 * 3/2013 Thrailkill ..... F21V 29/004 362/231
2013/0114241 A1 5/2013 Van De Ven et al.
2013/0190988 A1 6/2013 Maxik et al.
2013/0214704 A1 8/2013 Gerlach et al.
2014/0063776 A1 * 3/2014 Clark ..... F21V 23/008 362/20
2014/0117877 A1 * 5/2014 Mapel ..... H05B 33/086 315/294
2014/0168978 A1 6/2014 Hu
2014/0177227 A1 * 6/2014 Kim ..... F21S 8/063 362/294
2014/0254154 A1 * 9/2014 Catalano ..... F21V 13/10 362/243
2015/0098239 A1 4/2015 Benoit et al.
2015/0173151 A1 6/2015 Ter Weeme et al.
2015/0373806 A1 * 12/2015 Vissenberg ..... H05B 33/0872 315/151

OTHER PUBLICATIONS

Glickman et al., "Inferior Retinal Light Exposure Is More Effective than Superior Retinal Exposure in Suppressing Melatonin in Humans", Journal of Biological Rhythms vol. 18 No. 1 (Feb. 2003).

Brainard et al., "Sensitivity of the Human Circadian System to Short-Wavelength (420-nm) Light", Journal of Biological Rhythms, DOI: 10.1177/0748730408323089 (2008).

* cited by examiner

LAMP WITH DIRECTIONAL, INDEPENDENTLY VARIABLE LIGHT SOURCES

CROSS REFERENCES TO RELATED APPLICATION

The present application claims the benefit of provisional patent application Ser. No. 62/054,545, filed 24 Sep. 2014.

BACKGROUND OF THE INVENTION

The present invention relates to a novel and useful lighting device having variable light color and light projection direction.

Circadian systems of humans comprise variations and physiology in behavior that are coordinated with a cycle length close to 24 hrs. Circadian rhythms are present even in the absence of periodic environmental stimuli. Circadian rhythm synchronization is achieved by humans through regular exposure to naturally occurring periods of light and darkness.

During daylight hours, non-visual photosensitive cells in the retina respond to light and signal the human body to set, re-set, and adjust the human circadian rhythm. Although human circadian rhythms were once believed to be relatively in-sensitive to light and more sensitive to social cues, it has been found that the human circadian system is as sensitive to light as is the case with other diurnal organisms.

Such non-visual photo sensitive retina cells are particularly sensitive to blue light and to light emanating from above. Consequently, it is believed that exposure to blue light at night may have a negative health impact as a consequence of a delay of the human body to produce melatonin and through changes to other hormone levels. Conversely, light having blue content has been shown to increase alertness and is, thus, beneficial to humans during the day.

Conventional light fixtures having conventional bulbs are generally not able to change the color or the projection direction of the light produced. For example, a typical floor lamp falls in this category. Some light fixtures are manually adjustable in light direction projection or intensity. The latter is achieved by multi stepped reading lamps or by the use of dimming switches. In addition, home automation systems are available to control the intensities of multiple lamps through memory systems or by remote operation.

Recently, lamps having variable color and intensity have become available and may be remotely controlled by means of communication systems, including smartphone applications, internet web pages, or central control hubs. However, such lighting fixtures only offer projection of light in a fixed direction. In addition, such communication controlled lighting systems are subject to the problems of interference and latency.

In the past, many systems for projecting light to aid in the maintenance of a human circadian system have been proposed. For example, U.S. Pat. Nos. 6,686,691, 8,324,808, 8,686,641 and United States Patent Application Publication US2013/0140988, and US2015/0098239 describe lamps use multi-color sources of light such as, LED to produce biologically beneficial light.

U.S. Pat. No. 6,554,439 and United States Patent Application Publications US2060285324, US2009/012,2530, US 2011/0109445, and US2013/0114241 show illumination devices having multiple sources of color lamps mounted on a base and include controllers for operation.

U.S. Pat. Nos. 8,890,435 and 9,095,029 teach light sources having multiple LEDs sources of light of different colors, either formed into a strip or into side-by-side lamps shinning in one direction.

U.S. Pat. Nos. 6,350,275, 6,623,512, 7,679,281, 8,852,254, 9,039746 and United States Patent Application Publications US2004/0249423, US2008/0275533, and US 2009/0326616 reveal light emitting devices that generate multiple colors, usually in the form of LEDs, and are employed to medically treat patients and to reset human circadian rhythm systems.

United States Patent Application Publication US2008/0065177 illustrates a method of maintaining circadian rhythm in a subject by blocking retinal exposure to particular wave-lengths of light by utilizing filters.

U.S. Pat. No. 8,436,556 shows an LED lighting system involving multiple color light sources that are controlled to mimic sunlight on a cloudless day and to direct such light in an upward direction.

U.S. Pat. No. 8,581,520 and United States Patent Application Publications US2012/0306380, and US2013/0214704 describe lighting systems that project light using multicolor light sources in conjunction with natural light or a source of white light.

A lighting system that controls the emanation of light of a certain correlated color temperature and in multiple particular directions would be a notable advance in the field of interior lighting.

SUMMARY OF THE INVENTION

The present invention relates to a novel and useful device for creating and varying the correlated color temperature (CCT) of light and projecting the same in particular directions, is herein provided.

The device of the present invention utilizes a base having a first side and a second side. A support positions the base between the ground surface and a remote surface, such as a wall or ceiling of a structure.

A first source of light is located on the first side of the base and directs light to a first zone in the structure adjacent the ground surface. Likewise, a second source of light located at the second side of the base directs light to a second zone in the structure adjacent the remote surface. Each of the first and second sources of light comprise at least a first lamp emanating a light of a first pre-determined correlated color temperature and a second lamp emanating light of a second pre-determined correlated color temperature. Another lamp, such as a third lamp may also be employed in the present device to emanate light at a third pre-determined correlated color temperature.

A controller independently adjusts the intensity of each of the first and second lamps of the first light source, and the intensity of each of the first and second lamps of the second source to create an overall emanation of light of a particular correlated color temperature into the first and second zones according to a time schedule.

In addition, the lighting device may be formed with an envelope having first and second openings and a partition lying within the envelope to form first and second spaces. The first space communicates with the first opening while the second space communicates with the second opening of the envelope. The base is mounted relative to the partition to orient the first side of the base toward first opening and second side of the base toward the second opening. Needless to say, the first zone of the structure illuminated by light produced by the device of the present application, would lie next to the first opening of the envelope and the light entering the second zone of the structure would lie adjacent the second opening of the envelope. The envelope may also be provide a shade that at least partially surrounds the base and may be constructed of a heat conductive material to act as a heat sink for the device of the present invention. A diffuser may also be used within the envelope and be supported therewithin. The diffuser may be formed in two parts to intercept light emanating from the first and second light sources located on opposite sides of the base within the envelope. Moreover, a controller varying the intensity of the light emanating from the first and second light sources would be linked to a clock.

In certain cases, the base may take the form of a printed circuit board such that the first and second sources of light are fashioned into light emitting diodes. Any one of the light emitting diodes may be employed in conjunction with an optical converter or filter to alter the correlated color temperature of the light deriving from such emitting diode.

It may be apparent that a novel and useful lighting device that is operational within a structure and that provides light in multiple directions and at varying correlated color temperatures along a time line or schedule, is herein provided. It is therefore an object of the present invention to provide a lighting device operational within a structure that may be autonomously controlled.

A further object of the present invention is to provide a lighting device operational within a structure that utilizes a printed circuit board having light emitting diodes giving off light at particular correlated color temperatures according to a pre-determined program.

Another object of the present invention is to provide a lighting device operational within a structure that is compatible with a controller that is programmable and includes a memory.

A further object of the present invention is to provide a lighting device operational within a structure that provides light in particular zones within a structure, such light being of independently pre-determined correlated color temperatures without latency and free from radio interference.

Yet another object of the present invention is to provide a lighting device operational within a structure, that works in an efficient manner and is relatively economical to construct and maintain.

The invention possesses other objects and advantages especially as concerns particular characteristics and features thereof which will become apparent as the specification continues.

Figure 1:
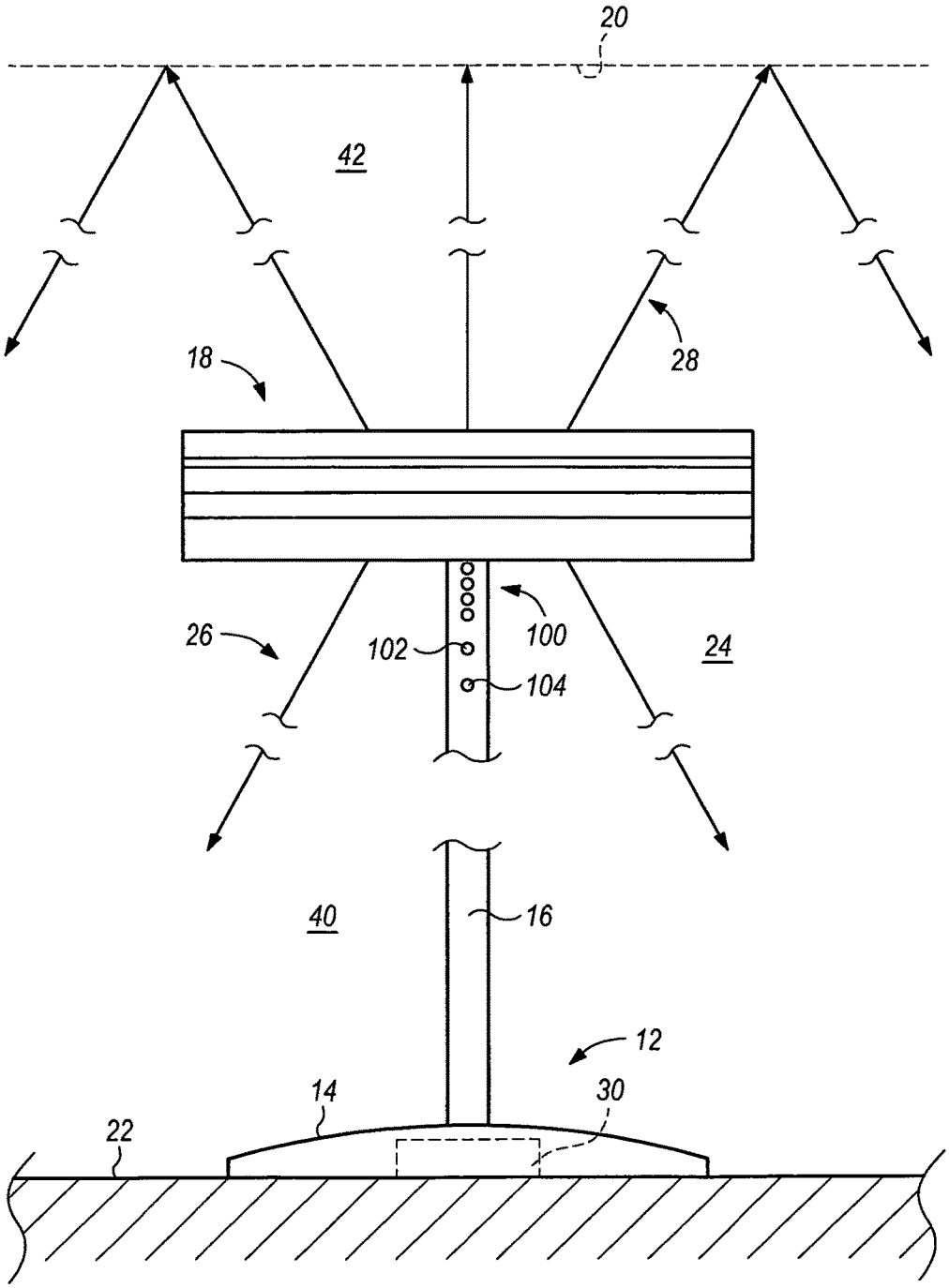
FIG. 1 is a side elevational view of the device of the present application.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

The lighting device of the present application is depicted as a whole in the drawings by reference character 10. Lighting device 10 includes as one of its elements a support 12, FIG. 1. Support 12 is formed with a weighted bottom 14 and an upwardly extending stem or arm 16. Envelope 18 positions at the upper portion of stem 16. Envelope or head 18 lies between an upper surface 20 and ground surface 22 of a structure 24 such as that found in the interior of a building. Needless to say, upper surface 20 may take the form of a ceiling or wall portion that lies above ground surface 22. Plurality of light rays 28 are directed upwardly to zone 42, while plurality of light rays 26 are directed downwardly to zone 40 from envelope 18, the details of which will be discussed as the specification continues. It should be further noted that weighted bottom portion 14 of lighting device 10 may serve as a mounting structure for power supply 30, which will be discussed hereinafter. However, envelope 18 may be mounted to a wall, piece of furniture and the like. Also, power supply 30 may position in line in a power cord or be wall mounted.

Figure 2:
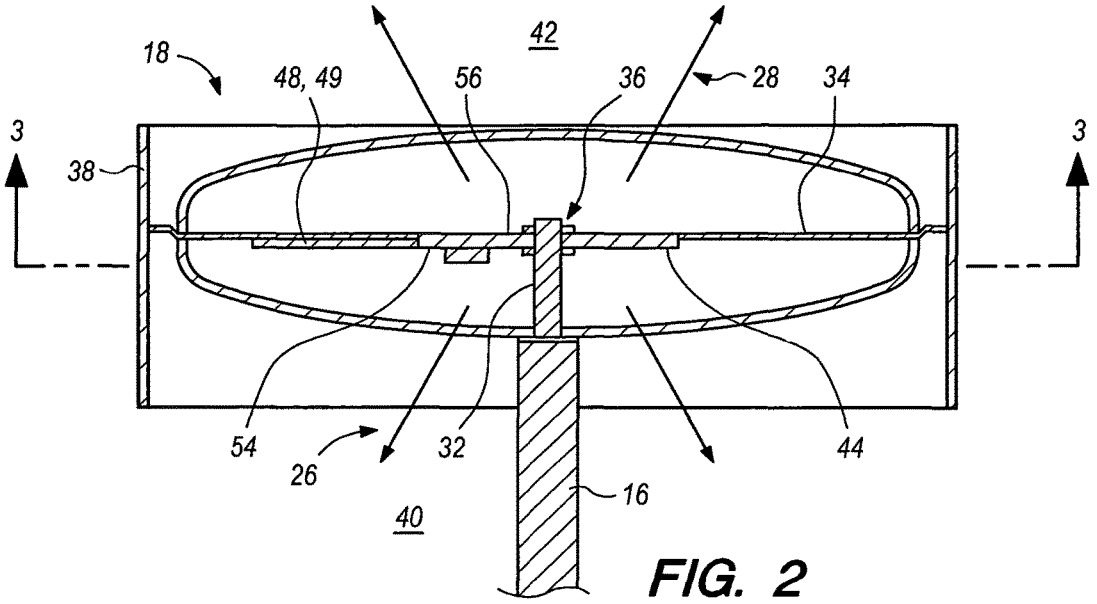
FIG. 2 is a sectional view of the envelope at the upper portion of the device depicted in FIG. 2.

Turning to FIG. 2, it may be observed that envelope 18 is presented in greater detail, in section. Envelope 18 includes a support rod 32 fixed to stem 16. A partition 34 mounts to rod 32 via a pair of retainers 36. Partition 34 extends outwardly from rod 32 and supports a shade 38, which may be constructed of heat conductive material and, thus, serves as a heat sink for energy generated by device 10. Partition 34 also generally serves to bifurcate the plurality of rays 26 and 28 emanating from device 10 into a first zone 40 toward ground surface 22 and a second zone 42 toward upper surface 20 of structure 24, FIGS. 1 and 2. In addition, partition 34 supports a base 44 mounted in an opening 46 through partition 34 to allow communication of base 44 with either zone 40 or zone 42. Partition 34 also supports a control electronics assembly 49, detailed hereinafter. Moreover, a wire connector 50 is mounted to base 44 and is electorally connected in a conventional manner to controller 48 found within electronics assembly 49 by the use conductors 52, illustrated in dashed lines.

Figure 3:
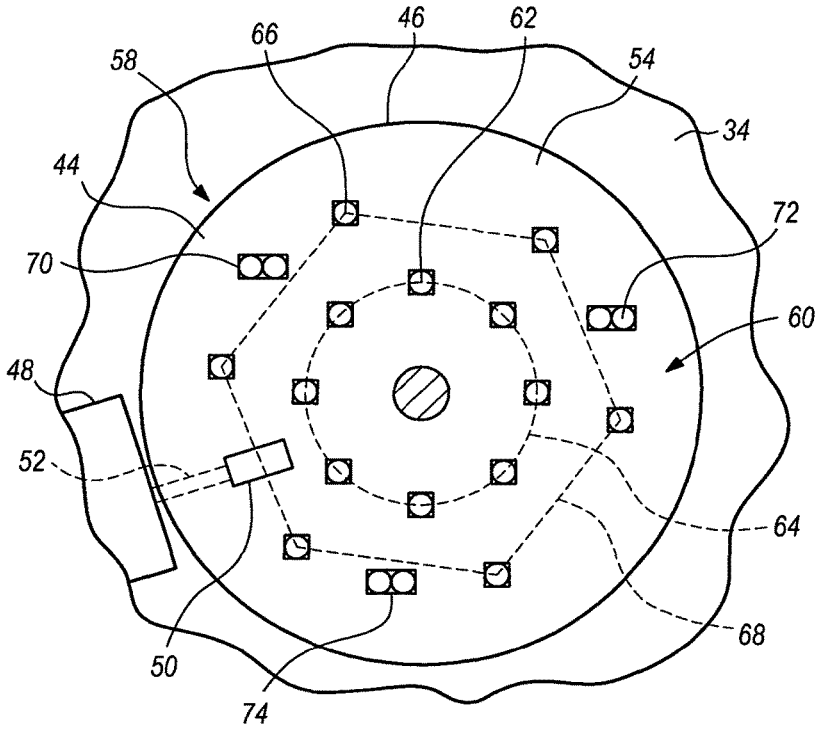
FIG. 3 is a sectional view taken long line 3-3 revealing the first source of light of the base of the device of the present invention, the second source of light on the opposite side of the base being similarly constructed.

Referring now to FIG. 3, it may be observed that first side 54 of base 44 is shown and is oriented toward first zone 40.

Base 44 is fashioned as a printed circuit board. The second side 56 of base 44, is identically constructed, with the exception of wire connector 50 fixed to first side 54.

Figure 4:
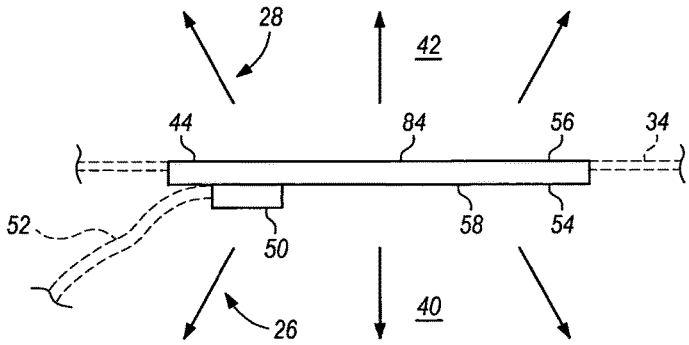
FIG. 4 is a side elevational view of the base portion of the device of the present invention.
Figure 5:
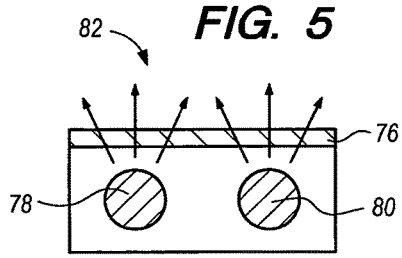
FIG. 5 is a schematic sectional view of a light emitting diodes source in combination with an optical filter or converter.

Again referring to FIG. 3, it may be seen that first side 54 of base 44 includes a first source or unit of light 58. In general, in the embodiment shown in FIG. 3, first source of light or unit of light 58 takes the form of a printed circuit board assembly 60 possessing a plurality of light emitting diodes generally categorized into three types. For example, light emitting diode 62 may emanate light at a correlated color (CCT) temperature of 6500K. Seven additional light emitting diodes similar to light emitting diode 62 are arranged on printed circuit board 60 in a generally circular pattern indicated by dashed line 64. LED 66 may emit light at a CCT of 4000K and is identical to five additional light emitting diodes lying along a hexagonal dashed line 68. Finally, a third group of light emitting diodes 70, 72, and 74 may project light at 2700K. Thus, first source of light 58 produces light from at least a first lamp of a pre-determined correlated color temperature and a second lamp of a second pre-determined correlated color temperature. It should be noted that light emitting diodes sources 70, 72, and 74 may be altered by the use of an optical filter or converter 76 that overlies light emitting diodes 78 and 80 originally producing light at a CCT of 2700K, FIG. 5. The resulting light rays 82 lie at about approximately a CCT of 1800K with little blue content. Filter 76 may take the form of a phosphor sheet such as one manufactured by PhosphorTech Corporation of Kennesaw, Georgia under the designation "RadiantFlex™". Optical filter 76 or converter essentially converts blue light from LED 78 and 80 into light ranging from green to red in an inexpensive and efficient manner. Of course, light emitting diodes producing light at 1800K with little or no blue content may be used instead of LED 70, 72, and 74 as shown on FIG. 3. It should be realized, that a second source of light 84 at second side 56 of base 44 is found in device of the present invention. Second source of light 84 would be identical to that shown in FIG. 3 with the exception of mounted wire connector 50. Again, FIG. 4 represents the generation of light from first source of light 58 and from second source of light 84 into zones 40 and 42, respectively. Such light projection emanate directly or via reflectors. Of course other lamps or LED's emitting light of a certain CCT, other than shown above, may be employed in device 10. In addition first and second sources of light 58 and 84 may be arranged apart from one another without the employment of a common base 44.

Figure 6:
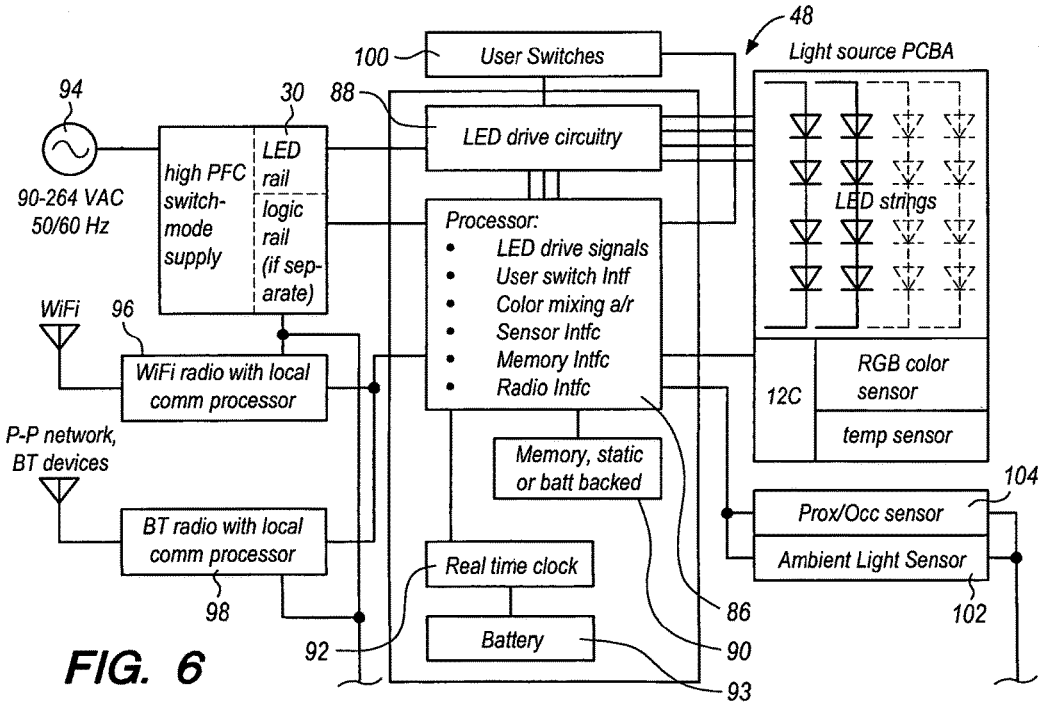
FIG. 6 is a schematic diagram indicating the operation of the controller of the present application.

With reference to FIG. 6, it may be apparent that a functional schematic is revealed for controller 48 which is capable of independently adjusting the intensity of any of the first and second lamps or LEDs of first light source, and the intensity of any of the first and second lamps of the second light source 84, according to a time schedule or time line which will be discussed as the specification continues.

Again looking at FIG. 6, controller 48 includes a processor 86 that is shown in conjunction with drive circuitry 88. For example, processor 86 and drive circuitry 88 may be combined into a programmable component sold by Cypress Semiconductor Corporation of San Jose Calif. under the designation PSoC part number CY8CLED04D01. Control of light sources 58 and 84 on either side of base 44 takes place in current mode with intensity being controlled via pulse width modulation that is dithered to reduce radio frequency interference. Also, such control takes place at a sufficiently high frequency (1.5 kHz or greater) to avoid the physiological effects of flicker, common to many conventional LEDs, fluorescent lamps, and bulbs. Of course, other methods of intensity control of light sources 58 and 84, such as analog control of current, may be employed with device 10 of the present application. Memory 90 may be provided by a static or battery backed RAM combined with a real time clock 92 of conventional configuration. Battery 93 maintains real time clock 92, whether or not external power source 94 is provided. For example real time clock 92 may take the form of one sold by Texas Instruments Incorporated of Dallas Tex. under the designation BQ32000. It should also be noted that back-up battery 93 may take the form of a super-capacitor. Radio 96 permits connection of control 48 to the global computer network or internet via WI-FI for communication of time synchronization signals, program changes, and other signals. For example, a radio 96 provided by Texas Instruments Incorporated of Dallas Tex. under the designation CC3000 would suffice in this regard. In addition, a Bluetooth radio 98 is found in controller 48. For example, a radio sold by Texas Instruments Incorporated of Dallas Tex. under the designation CSR1010 may be employed as Bluetooth radio 98. Bluetooth radio 98 offers Bluetooth communication with portable devices such as smart-phones and tablet computers. It is also realized that other forms of communication and attendant radios may be employed for communication between first and second sources of light 58 and 84, such as systems known as ZIGBEE or 6LoPan. First and second sources of light 58 and 84 may also operate in a star network, receiving updates only via WIFI. With reference to FIG. 1, it may be observed that plurality of manually operated user switches 100 positioned along stem 16 may be employed to override or adjust the resident program found in processor 86 of controller 48. Ambient light sensor 102 and occupancy sensor 104 are also mounted on stem 16. Of course, ambient light sensor and optional occupancy sensor 104 may be mounted elsewhere on device 10, such as at the top of envelope 18. AC-DC converter or power supply 30 located at the bottom portion 14 of device 10, supplies power to controller 48. Power supply 30 may take the form of one available from Meanwell USA of Fremont, Calif., as an open frame switching supply, model EPS-35-36. Moreover, processor 86, memory 90 and real time clock 92 may be combined with radio 96 or 98 to form a single unit.

In operation, the device 10 embodiment delivers white light having correlated color temperatures (CCT) ranging between 1800K to 6500K via light sources 58 and 84 on opposite sides of base 44 into zones 40 and 42, respectively, FIG. 1. Both the color and intensity of the white light and directed to zones 40 and 42 may be varied with the time of day according to controller 48. In addition, operation of device 10 may also be controlled directly by the user through switches 100 which will override the program found in processor 86. Further, device 10 may be operated by connected computing devices or other remote devices through radio 98 via WIFI, FIG. 6.

Figure 7:
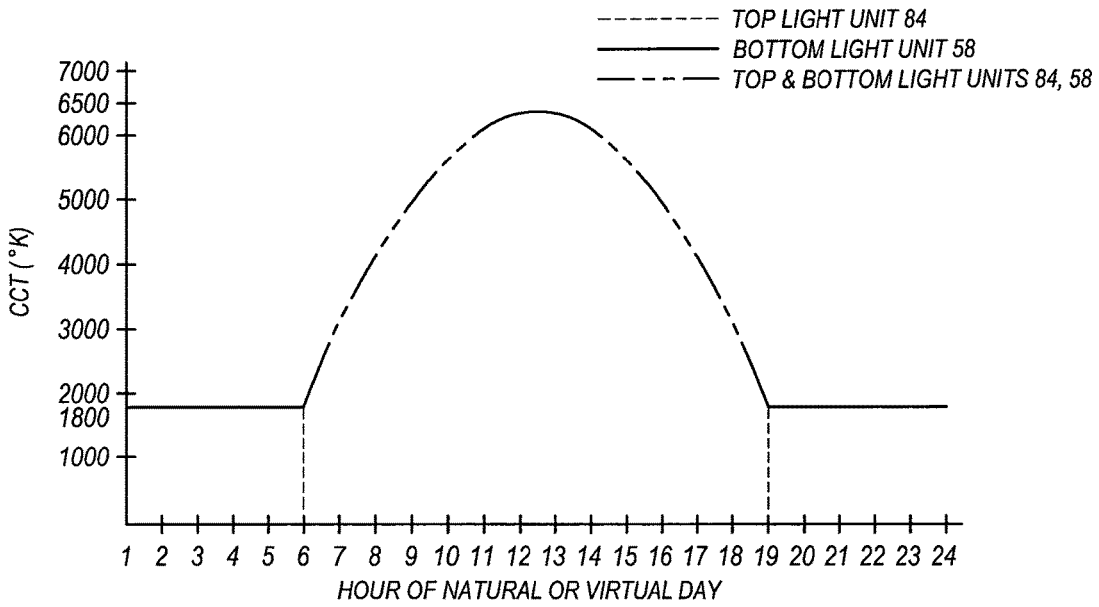
FIG. 7 is a graph indicating the correlated color temperatures of the device emanating from the top and bottom light sources or units of the device of the present application.
Figure 8:
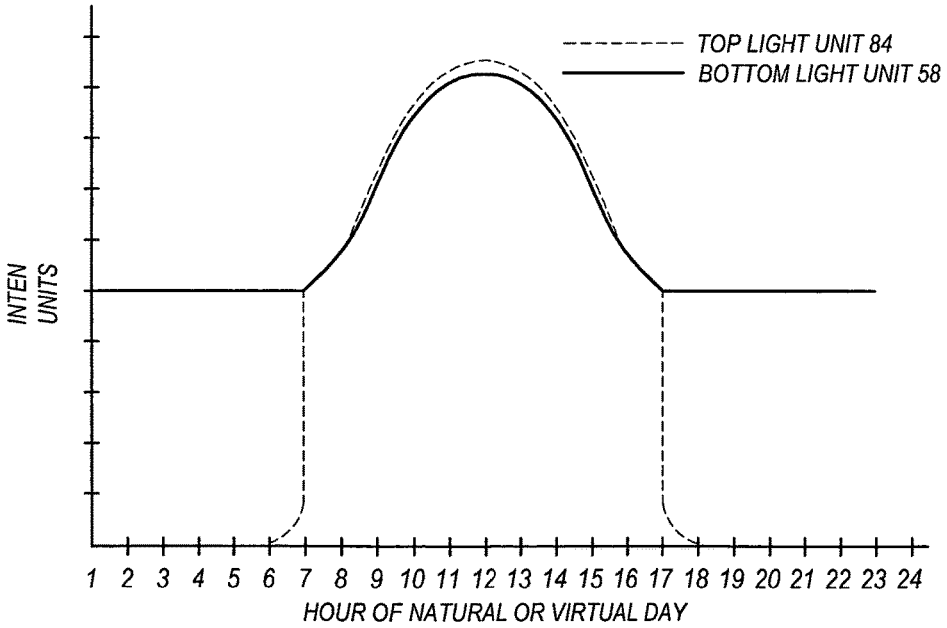
FIG. 8 is graph showing the intensity of light emanating from the top and bottom sources or light units during the hours of a natural or virtual day.

Turning now to FIGS. 7 and 8, it may be noted that the intensity and direction of light from light sources 58 and 84 may be varied to follow certain schemes to mimic a natural or virtual day. For example, FIG. 7 indicates that at the beginning of the natural or virtual day the light from bottom light unit from first source of light 58 illuminates at a CCT of 1800K. Such natural or virtual day is intended to coincide with that of a user, such as a shift worker. As time progresses, top light unit or second source of light 84 will also provide light at 1800K until approximately 6:00 AM. At this point, light sources 58 and 84 will smoothly increase in intensity and shift in CCT such that the composite CCT at midday (noon) from both sources will lie at 6500K. In other words, lamps within first and second sources of light from lamps, such as lamps 62, will dominate. At this point, the color of light coming from light sources 58 and 84 may dwell and then ramp down, finally reaching a composite light possessing a CCT of 1800k at approximately 5:00 PM, where light from lamps such as lamps 70, 72, and 74 dominate. At this point, light from light source 84 will turn off and cease to send light into zone 42 above device 10. However, light from source 58 will continue to be generated illuminating zone 40 below envelope 18 until the end of the natural or virtual day. Of course, other schemes of control are possible such that illumination of zone 40 below envelope 18 has a lesser intensity than the light emanating from second source of light 84 during the middle of the day. FIG. 8 indicates the intensity of first and second sources light relative to the particular CCT found in FIG. 7 during the sequence or scheme described above.

Figure 9:
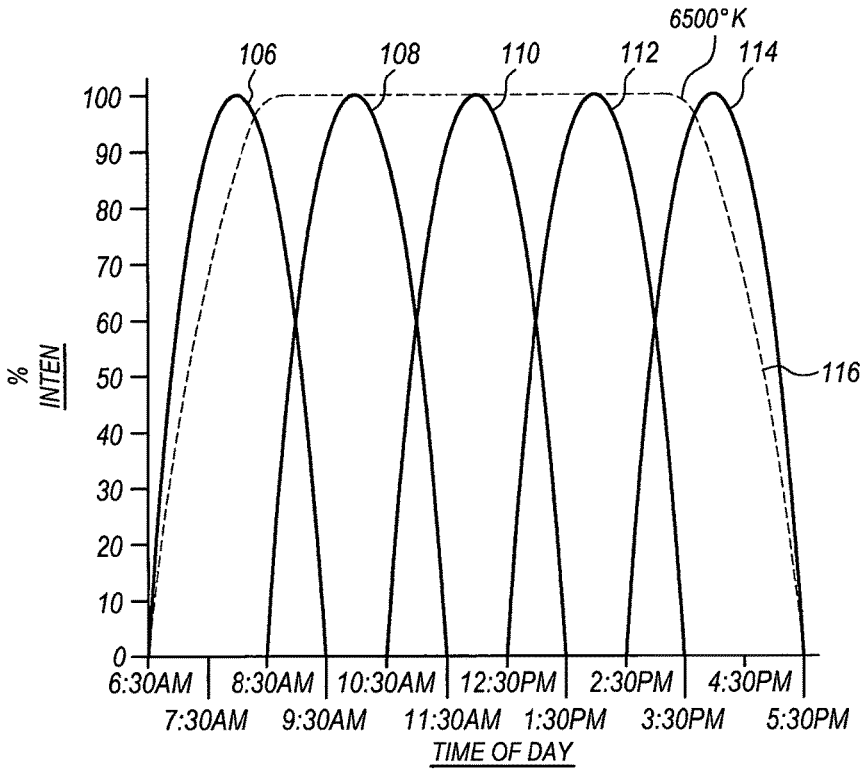
FIG. 9 is a graph indicating light emanating from multiple devices of the present application when operated simultaneously.

With respect to FIG. 9, it is shown that the intensity of light from sources of light 56 and 84 may be varied using multiple lighting units whose intensities one noted by graph 106, 108, 110, 112, and 114. The composite intensity from lighting unit 106, 108, 110, 112, and 114, is noted by the dashed line 116 of FIG. 9, reaching a peak of CCT 6500k between 7:30 AM and 4:30 PM. Devices similar to device 10 may be placed adjacent to one another to create the arcs lines 106, 108, 110, 112 and 114 of light shown in FIG. 9 on the inside surface of a building ceiling such a dome, or to the ceiling and walls of a rectilinear built space. Such a system would mimic or present, to an observer, the sense of being outdoors.

Figure 10:
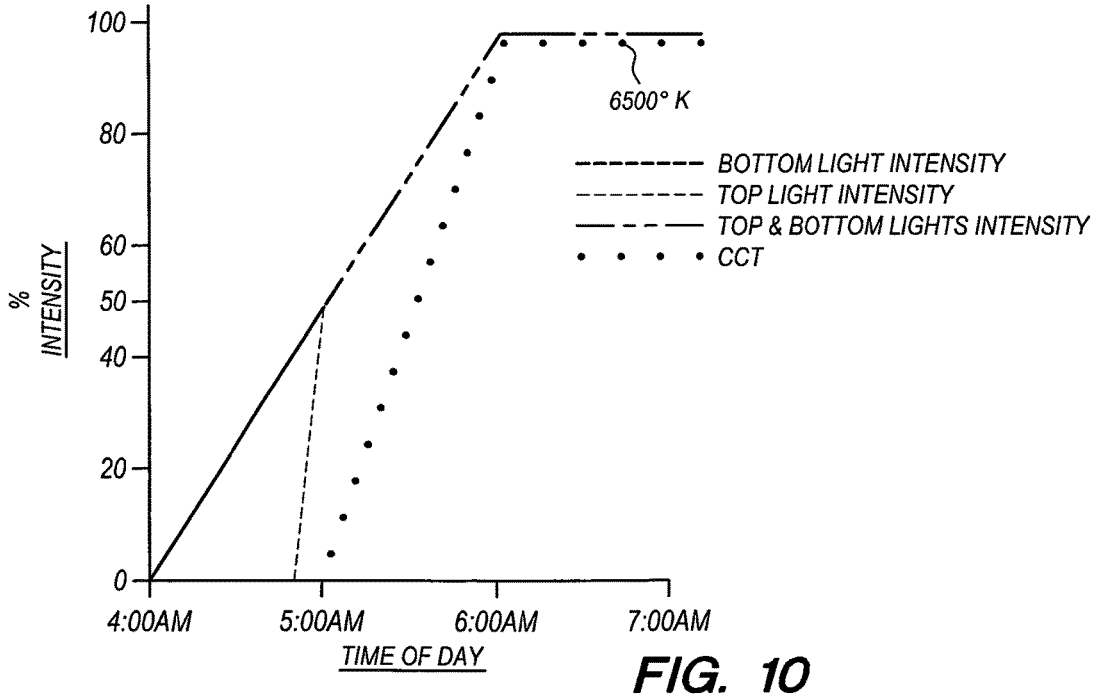
FIG. 10 is a graph indicating the intensity of the top and bottom light sources of units and the overall correlated color temperature of emanated light from device of the present application being used to mimic daybreak.

As a further example of the operation of the device 10 of the present application, FIG. 10 indicates the simulation of dawn which may be employed as a bright light therapy for treating seasonal affective disorder. Device 10, thus, may be programmed to provide intensity, color, and direction cues appropriate to a particular therapy method or therapy study.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A portable lighting fixture operational within a room having a ground surface and a ceiling surface, to independently control upward and downward illumination of the room, comprising:

a base, said base having a first side facing downwards towards the ground surface and a second side facing upwards towards the ceiling surface;

a support for positioning said base between said ground surface and said ceiling surface;

a first light source located at said first side of said base, directing light towards the ground surface;

a second light source located at said second side of said base, directing light upwards to directly illuminate the ceiling surface;

said first and second light sources each comprising at least a first lamp emanating light of a first predetermined correlated color temperature and a second lamp emanating light of a second predetermined correlated color temperature;

an envelope structure mounted to said support and encompassing the base, the first light source, and the second light source, the envelope structure having a top portion through which light from the second light source passes towards a portion of the ceiling surface directly above the lighting device without obstruction by the lighting device, and a bottom portion through which light from the first light source passes towards the ground surface without obstruction by the envelope structure; and a controller for independently adjusting the intensity of each of said first and second lamps of said first light source, and the intensity of each of said first and second lamps of said second light source, to independently vary, according to a time schedule, the composite color and intensity of (a) light projected by the first light source against the ground surface, and (b) light projected by the second light source against the ceiling surface;

said envelope structure bottom portion comprises a first opening and said envelope structure top portion comprises a second opening, the envelope structure further comprising a partition lying within said envelope structure, said partition forming a first space communicating with said first opening and a second space communicating with said second opening, said base being mounted relative to said partition to orient said first side of said base toward said first opening and said second side of said base toward said second opening, said envelope structure further comprises a shade circumscribing said base, said base comprises a printed circuit board and said first and second sources of light comprise a plurality of light emitting diodes, and the partition comprises an opening hole in the center of the partition, and the printed circuit board is disposed within the opening hole, and the partition extends out to and is in direct contact with the shade, and the shade is supported on the partition.

2. The portable lighting fixture of claim 1 in which said shade comprises a heat conductive member.

3. The portable lighting fixture of claim 1 which further comprises a diffuser supported at said envelope structure, said diffuser diffusing light emanating from said first and second sources of light.

4. The portable lighting fixture of claim 1 in which said controller further comprises a clock.

5. The portable lighting fixture of claim 1 in which at least one of said light emitting diodes includes an optical filter.

6. The portable lighting fixture of claim 1 in which said first and second light sources each further comprises a third lamp emanating light of a third predetermined color temperature.

* * * * *